US008091707B2

(12) United States Patent
Egan et al.

(10) Patent No.: US 8,091,707 B2
(45) Date of Patent: Jan. 10, 2012

(54) DURABLE SHIPPING CONTAINER FOR HEAVY SENSITIVE ELECTRONICS

(75) Inventors: Martin Shawn Egan, Ballwin, MO (US); Elizabeth Gale Egan, Ballwin, MO (US); Adam Richard Egan, Ballwin, MO (US)

(73) Assignee: MSE Innovations LLC., Ballwin, MO (US)

( * ) Notice: Subject to any disclaimer, the term of this patent is extended or adjusted under 35 U.S.C. 154(b) by 0 days.

(21) Appl. No.: 12/804,415

(22) Filed: Jul. 21, 2010

(65) Prior Publication Data

US 2011/0068035 A1 Mar. 24, 2011

Related U.S. Application Data

(60) Provisional application No. 61/277,104, filed on Sep. 21, 2009.

(51) Int. Cl.
*B65D 81/02* (2006.01)

(52) U.S. Cl. ..... 206/523; 206/3; 206/592

(58) Field of Classification Search ..... 206/3, 723, 206/521, 591, 592, 585, 722, 446, 509; 220/4.21, 220/4.22

See application file for complete search history.

(56) References Cited

U.S. PATENT DOCUMENTS

| | | | | | |
|---|---|---|---|---|---|
| 3,339,781 | A * | 9/1967 | Confer et al. | ..... | 206/592 |
| 4,234,092 | A * | 11/1980 | Axel | ..... | 206/523 |
| 4,356,913 | A * | 11/1982 | Moraine | ..... | 206/3 |
| 5,031,768 | A * | 7/1991 | Fischer | ..... | 206/370 |
| 5,160,075 | A * | 11/1992 | Moscovitch | ..... | 224/328 |
| 5,871,097 | A * | 2/1999 | Shida et al. | ..... | 206/521 |
| 6,131,760 | A * | 10/2000 | Huang | ..... | 220/526 |
| 6,321,911 | B1 * | 11/2001 | Raimer et al. | ..... | 206/509 |
| 6,595,362 | B2 * | 7/2003 | Penney et al. | ..... | 206/364 |

* cited by examiner

*Primary Examiner* — David Fidei

(57) ABSTRACT

A system and method for securing, shipping, storing, loading, unloading, accessing and protecting sensitive heavy electronic assemblies. Integration of container dunnage, recessed hardware and exterior stacking features to protect container and contents during shipping.

3 Claims, 8 Drawing Sheets

DURABLE SHIPPING CONTAINER FOR HEAVY SENSITIVE ELECTRONICS

TECHNICAL FIELD

This disclosure is generally directed to consumer and, commercial products for shipping sensitive heavy electronic equipment by over night express carriers.

Applicable U.S. patent Classification Definitions include, descriptions in Group III 414-224 788.1 Package and Article Carriers, 220-190 1.5 Freight Container and 220-206 Special receptacles or Packages.

BACKGROUND

There is currently a need for shipping containers for heavy, sensitive electronic equipment to be shipped routinely. Over night carriers have size and weight limitation for overnight shipments. Our investigation into the shipping requirements and design/engineering time has resulted in the invention being described.

Currently heavy electronic equipment is shipped in metal or wood based crates that exceed weight and dimensional limitations for overnight express shipments. Metal and wood shipping containers have additional expense and shipping limitations. The current container systems are heavy and require forklifts to move even when empty. An opportunity exists to design/engineer an alternative shipping container that would reduce shipping expense and time.

Our investigation in this design challenge helped define a number of consumer needs integrated into our design.

The container should be able to ship empty, half full or completely full. Shipments can include single components and an assembly of components. Users of the container would benefit if they could gain access to one complete set of components without removal of the other set.

Our investigation found most containers for shipping electronics use gray shipping foam, paper, small bags of air or polyurethane foam bag packs (dunnage) that fit around the items to be shipped. These systems require the removal of dunnage material to gain access to the items being shipped. The removal of dunnage can result in loss of dunnage not replaced in the proper position. An opportunity exists to improve on placement and use of dunnage.

It would be beneficial if the container had replaceable skid pads. Due to the weight of the items being shipped and sensitivity of the electronics, an opportunity exists to design a skid pad that reduces impact, extends wear and promotes transporting.

Quick lid removal is also desired. Current over night wood and metal container systems including crates can require the use of common hand tools to gain access. Our investigation of lid retaining and removal highlighted an opportunity to improve this process by eliminating the need for tools.

Investigation into container requirements highlighted the need for rope tie downs to hold containers in position during transit. It would be an improvement to include rope tie downs on a plastic container meeting the size limitation for overnight carriers.

Our Investigation into container requirements highlighted the need to eliminate sharp corners that could present harm to users, surrounding cargo and surfaces during transit on a plastic container.

Our Investigation into container requirements highlighted the need to protect hardware from damage, weather and unwanted access. It would be an improvement to design a plastic container protecting hardware from damage, weather and unwanted access for overnight carriers.

Investigation into container requirements highlighted the need to transfer container by use of fork lift, lift trucks and promote stack ability on a plastic container. It would be an improvement if these features can also be incorporated into a plastic shipping container.

Investigation into the container requirements highlighted the need for shock and isolation systems to reduce damage to sensitive electronics. It also highlighted a need for heavy sensitive electronics needing additional support over long periods of time. Again as it relates to plastic shipping containers.

Investigation also highlighted the need to protect hardware from the elements including water, ice, dust, sand, frost and mud. Providing protection will promote proper use and could eliminate injury. It would be an improvement if these features are also included on a plastic storage container meeting size limitation for over night carriers.

It would be an improvement to incorporate a dunnage system the allows users access to one complete component assembly leaving one or more assemblies stored and retained by dunnage that is integrated with the container.

BRIEF SUMMARY OF THE INVENTION

Summary Overview

This Non Provisional application is being submitted and references the provisional application 61/277,104 with a filing date of Sep. 21, 2009. This disclosure provides a system and method for storing, shipping, loading, unloading, accessing and protecting sensitive heavy electronics during transit by overnight carriers. This disclosure also provides a system and method for accessing components stored inside container.

Multiple Assemblies

According to one embodiment of the present disclosure, the container stores one or more assemblies including accessories and provides access and removal of one full set of components for use. Storage of items is symmetrically designed allowing removal of one full component assembly and all accessories. The container is designed to maintain a safe operating condition allowing shipping in all configurations including empty.

Dunnage

In yet another embodiment, the present disclosure provides an apparatus and method to organize and simplify dunnage. Due to sensitive electronics, our design uses sorbothane material that is permanently fixed inside the container. This reduces the chance of dunnage being lost, misplaced or misused. Because our dunnage material is integrated into the design and stays inside the container, our design is user friendly eliminating questions on placement. It allows access to a wide range of parts. Various types of dunnage materials can be used based on sensitivity of electronic equipment.

Container Surfaces

Container surfaces are curved, promoting good part design and quality. The interior space can be formed to fit a wide range of items being shipped. This will result in less air space and moisture inside the container which could damage electronics.

Skid Pad Design

In yet another embodiment, the present disclosure provides an apparatus and method for reducing shock. The skid pads have been designed using common available components allowing field replacement. The pad consists of a round wood skid, sorbothane isolator, bolt, washer sleeve and other common components. The design allows movement in the vertical direction should the container be dropped. Sorbothane isolators will expand outward reducing the impact to the container. The washer sleeve allows proper spacing and movement of these components.

Toolless Lid Removal

In yet another embodiment, the present disclosure features a lid that can be removed without the use of any tools. Incorporating the use of slip style hinges on this plastic shipping container will allow the lid to be slid off pivot pins without the use of tools. The placement of our hinges has been staggered to promote easy assembly when aligning and reinstalling the lid on the pivot pins. In addition the lid and base features a nylon strap to use as a lid stay system to prevent accidental rotation of the lid reducing damage and injury to users.

Tie Downs

In yet another embodiment, the present disclosure provides an apparatus and method to provide tie downs placed on the lid or base as needed. Inserts in tooling will allow placement in either position. The ties downs can be positioned under an over hang protecting them from the elements. When they swing out to 90 degree the user has full access.

Rounded Aesthetics

In still another embodiment, the present disclosure provides a rotational or blow molded container with both interior and exterior features to support cargo. Wide ranges of material are available depending on operating conditions. Both of these processes require generous radius corners to promote good parts. In addition these rounded corners improve the container function in tight spaces, preventing it from catching edges. The large corners will also prevent damage to other cargo containers and injury to workers.

Stacking Feature

In still another embodiment, the present disclosure provides a system and apparatus to carry heavy loads of sensitive electronics. Estimated loads could exceed 530 lbs total including the container. Our container is designed to maximize space by allowing user to stack the container. Interlocking closing features hold the lid and base in position and direct force straight down at the joint. In addition, large radius corners help transfer force away from the cargo and down to the ground. Large centering features prevent movement unless the container is picked up in a vertical direction. We have also provided clearance for forklift tines between the lid and base when stacked.

Interior Sorbothane Isolation

In still another embodiment, the present disclosure provides a system and apparatus to prevent damage from shock and impact to cargo inside the container. We have positioned sorbothane material in key position inside the container as needed to reduce damage to the cargo. Polyurethane foam is also used throughout the container for structure and to reduce the transmission of shock energy. Depending on the items being shipped, foam density can be adjusted to improve dampening effects.

Accessory Storage Pack

In yet another embodiment, the present disclosure provides an apparatus and method for providing two areas to store accessory components. Components would be secured in standard foam packing material cut to fit profiles. These accessory packs can be removed or permanently fixed inside the container using adhesive material.

Recessed Hardware

In still another embodiment, the present disclosure includes the recessed placement of hardware to protect it from the elements including rain, snow, ice dust, mud and frost. The recessed area will also obtain less sunlight reducing the amount of UV exposure. The recessed areas are designed to allow clearance when hardware is in the operating position.

DRAWING LIST

FIG. 1*a* Container Assembly ¾ View
FIG. 1*b* Container Lid Removed and Cargo ¾ View
FIG. 1*c* Container Base and Dunnage Location ¾ View
FIG. 1*d* Container Bottom ¾ View
FIG. 2*a* Container Lid Top ¾ View
FIG. 2*b* Container Lid Bottom ¾ View
FIG. 3 Skid Pad Assembly
FIG. 4 Slip Hinge Assembly and Detail View

BRIEF DESCRIPTION OF THE DRAWINGS

For a more complete understanding of this disclosure and its features, reference is now made to the following description, taken in conjunction with the accompanying drawings, in which:

FIG. 2*a* highlights recessed stacking and latch features along with the end lift handle and hasp. FIG. 2*b* highlights interior surfaces that are conformed to fit cargo. The image also shows a recessed pocket that mates features on the container base.

ADDITIONAL DETAIL DESCRIPTION

Project Review

The durable shipping container has been invented to protect expensive sensitive electronics during shipping and handling. Severe impact to electronic equipment could render it inoperable thus requiring service, time and cost. The container is designed to support shipping by overnight express carrier one or more electronic component assemblies and meet carrier shipping size and weight limitations.

Shock and Vibration Isolation Systems

We have engineered a container that will not only store items but incorporates key features to reduce shock levels if the container is dropped. Our solution uses advanced viscoelastic polymer materials (Sorbothane) known to reduce, absorb and dissipate shock energy by transferring the shock wave 90 degrees from the direction of impact and turning that energy into small amounts of heat. Other commonly known vibration and shock isolation materials can be used.

Isolation Rings

Figure 1A:
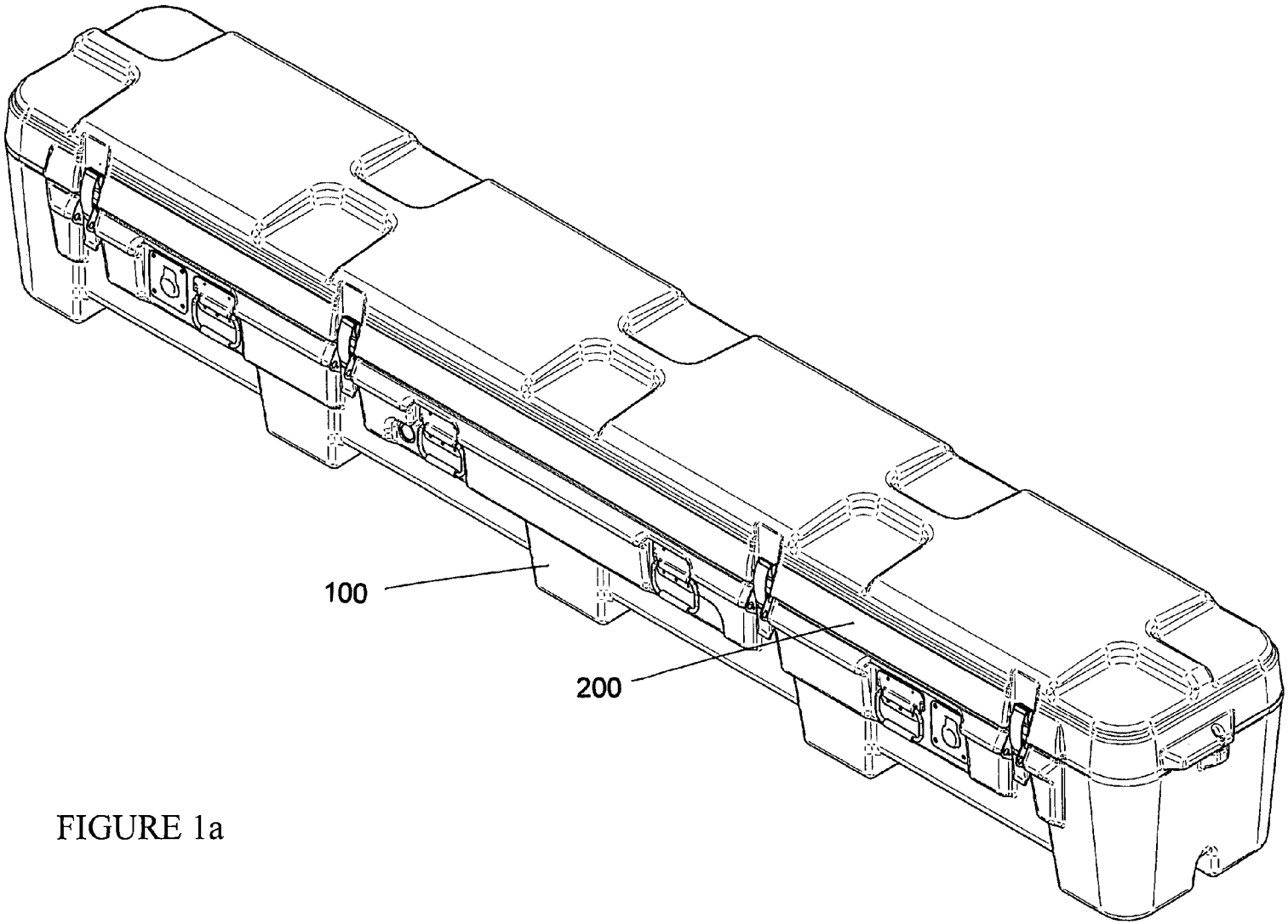
FIG. 1*a* is a somewhat simplified illustration of a shipping container assembly according to one embodiment of the present disclosure; this illustration shows the container lid, base, recessed latches, tie downs, handles, and pressure relief valve port, end lift handles and hasp, gasket, forklift access point and stacking features.
Figure 1B:
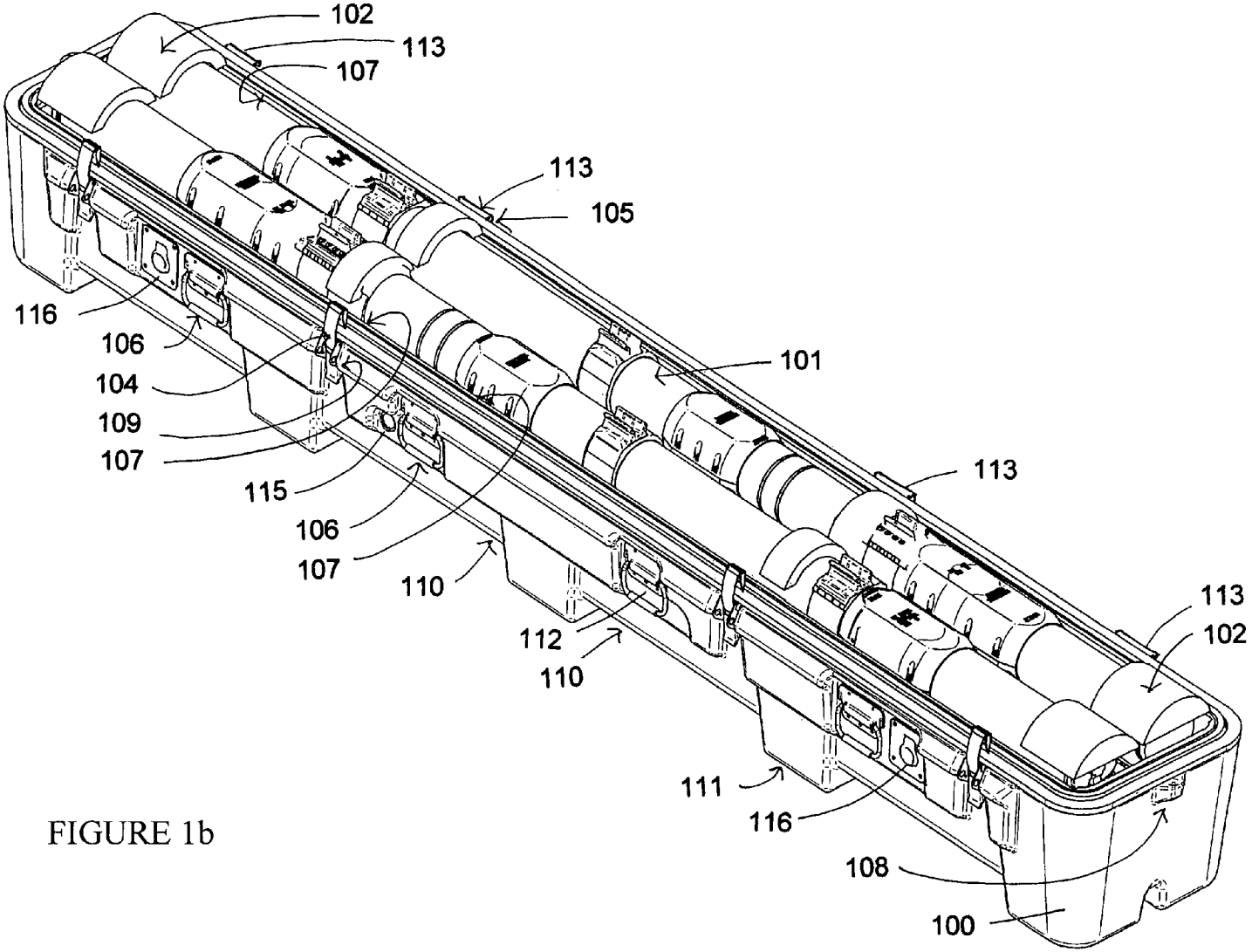
FIG. 1*b* is a somewhat simplified illustration of a shipping container with lid removed and heavy sensitive electronic cargo installed. This illustration shows dunnage how dunnage that would be retained with the lid cushions the cargo during shipping. It is position in this image to communicate that it is round in configuration and conforms to the lid interior. The illustration shows the container base, recessed latches, tie downs, handles, and pressure relief valve port, end lift handles and hasp, gasket, forklift access point, Lid dunnage, heavy electronic cargo and base mating features.
Figure 1C:
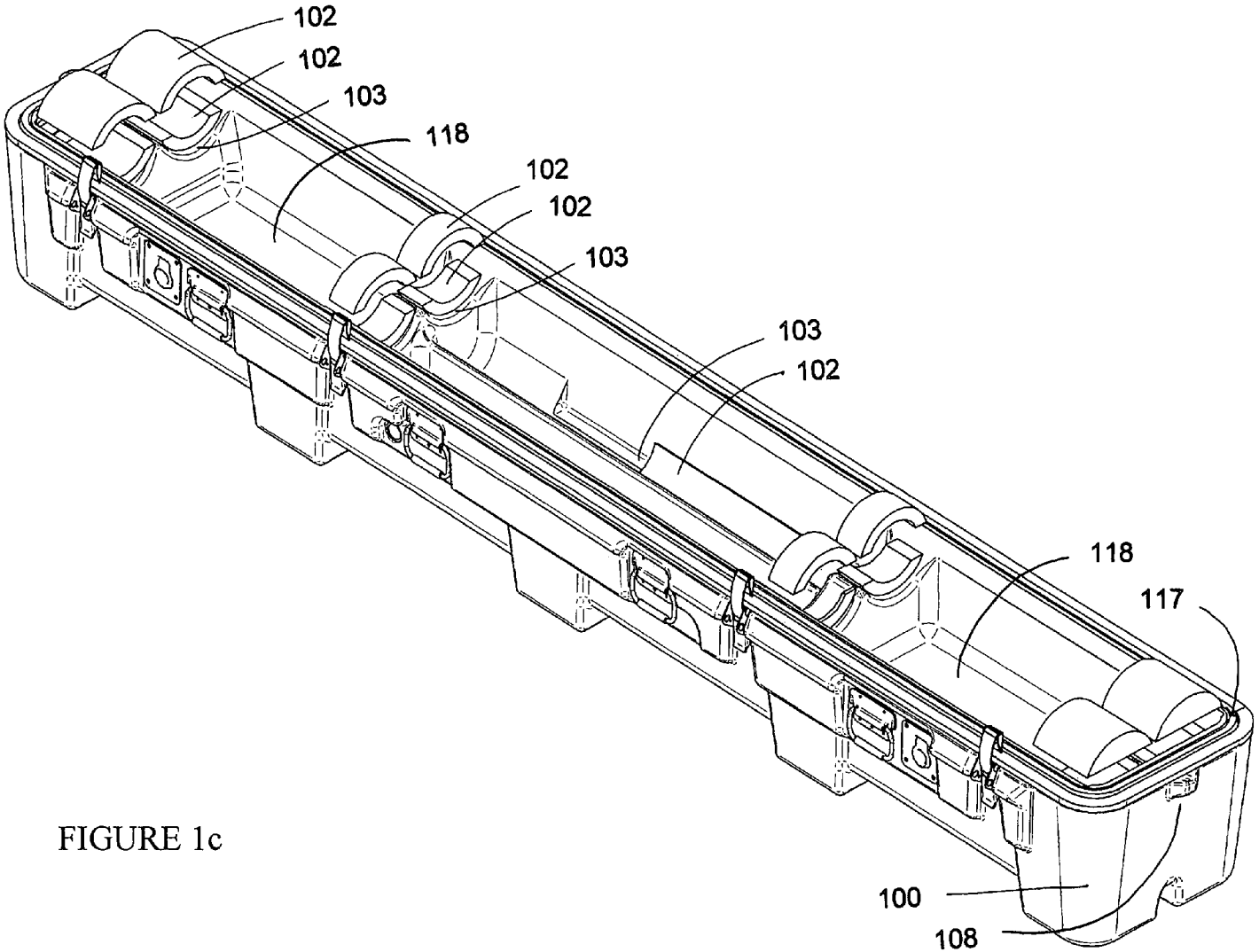
FIG. 1*c* shows a somewhat simplified illustration of a shipping container with lid and cargo removed. The image highlights interior features that conform to the cargo at the same time providing two accessory storage compartments at opposing ends. It highlights container features that help support heavy sensitive electronics.
Figure 1D:
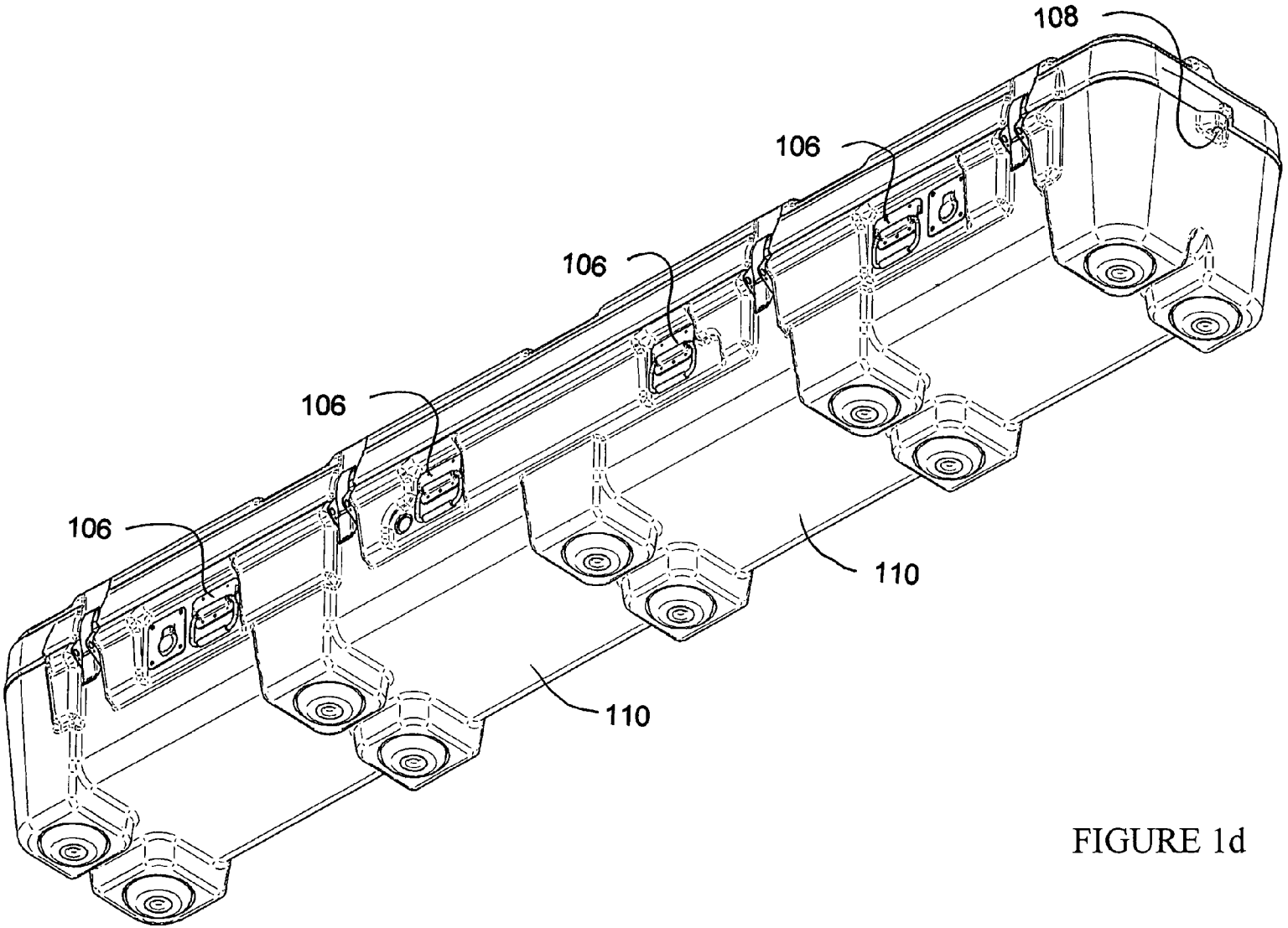
FIG. 1*d* shows a somewhat simplified illustration of a shipping container assembly from a bottom view. This illustration highlights skid pads and structural support pads to help transfer weight and align containers when stacked.
Figure 2A:
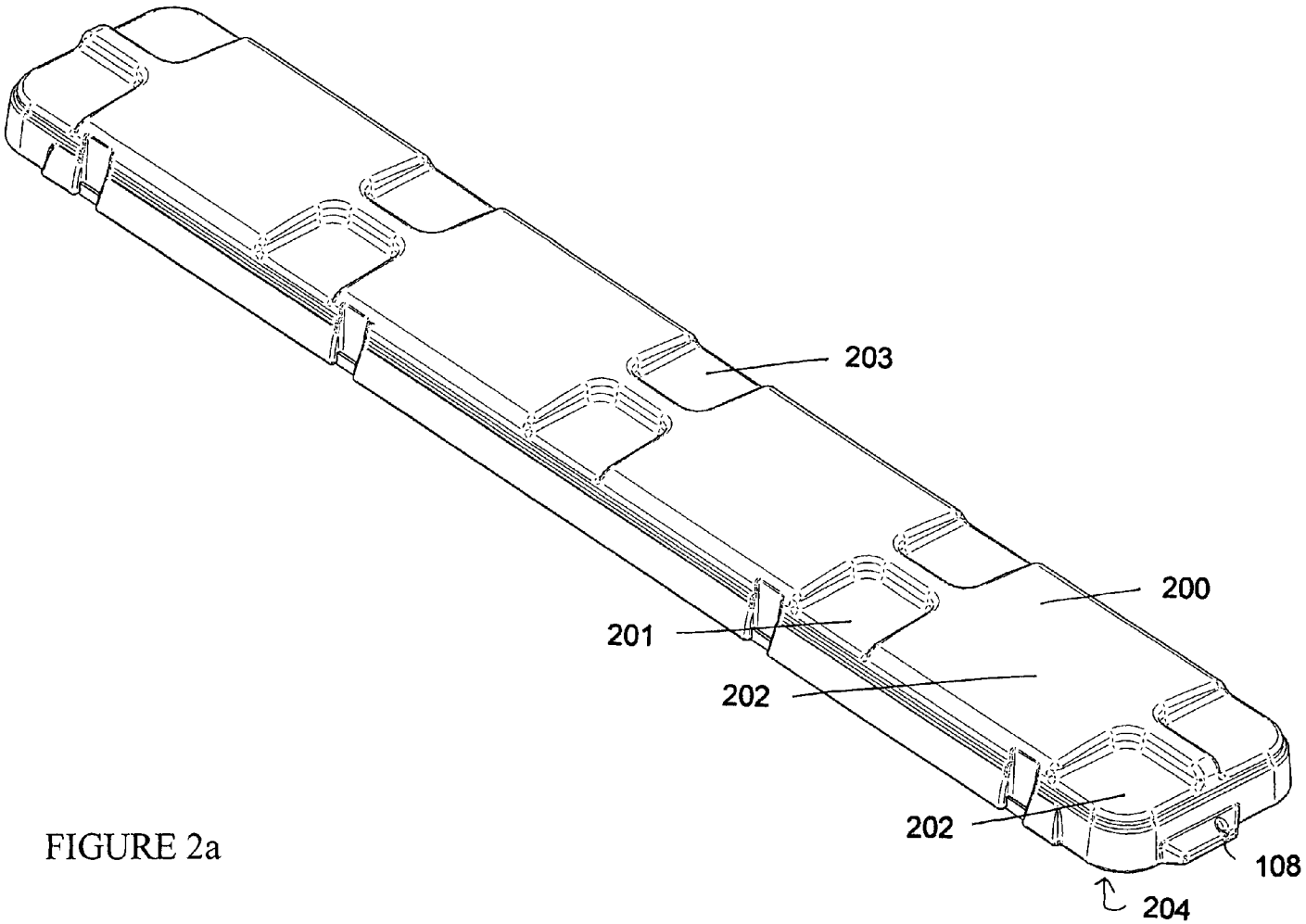
FIGS. 2*a* and 2*b* are somewhat simplified illustrations of the shipping container lid.
Figure 2B:
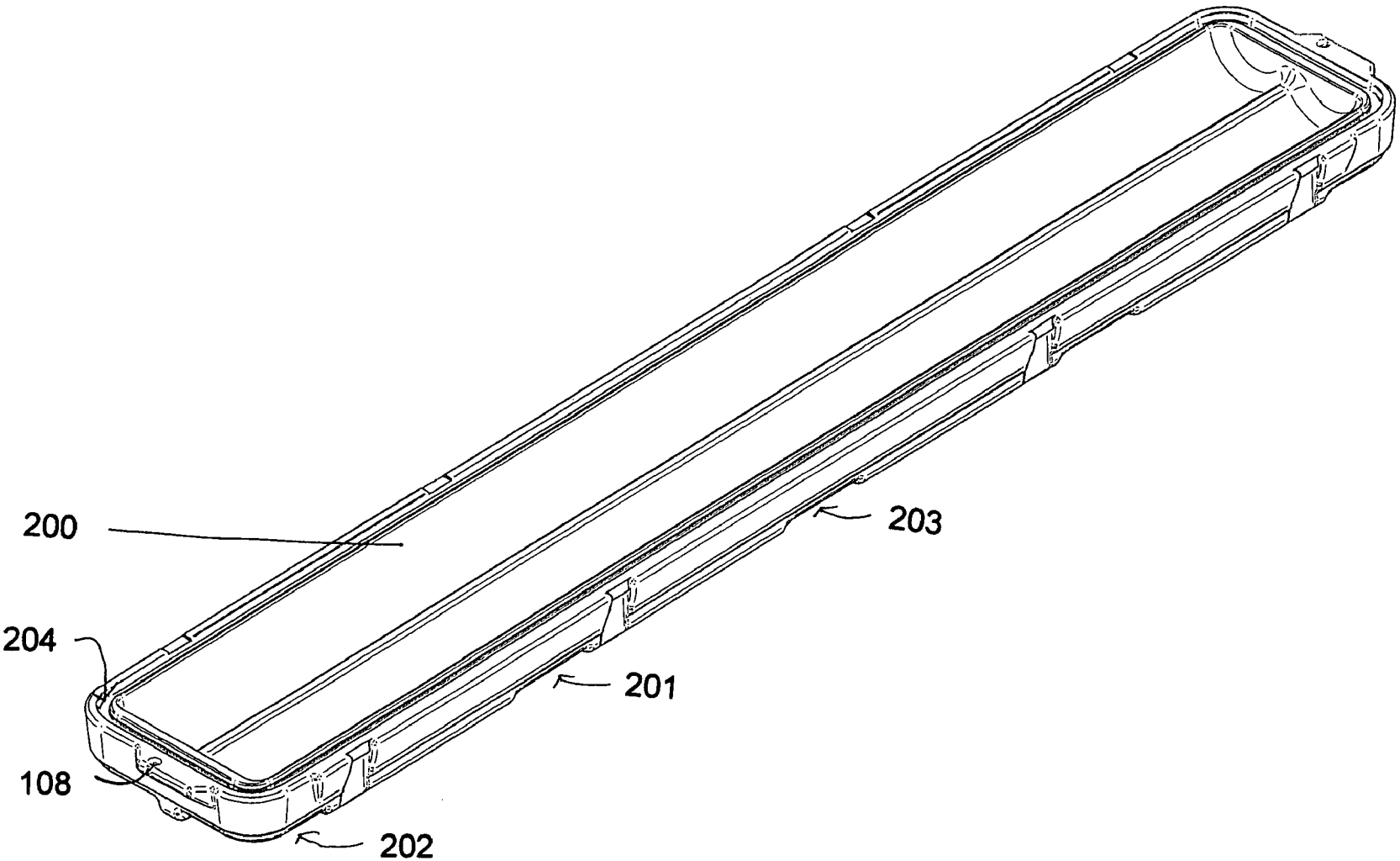
Figure 3:
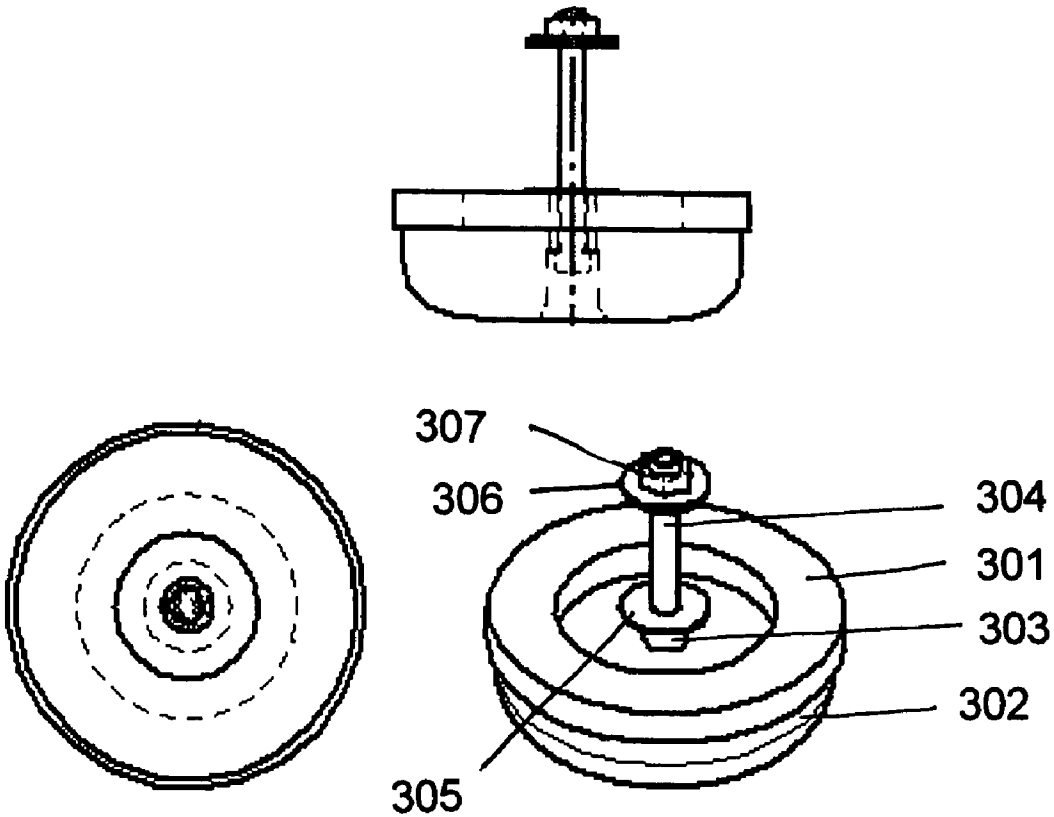
FIG. 3 is an somewhat simplified illustration of the skid pad design for shipping, impact and vibration reduction.
Figure 4:
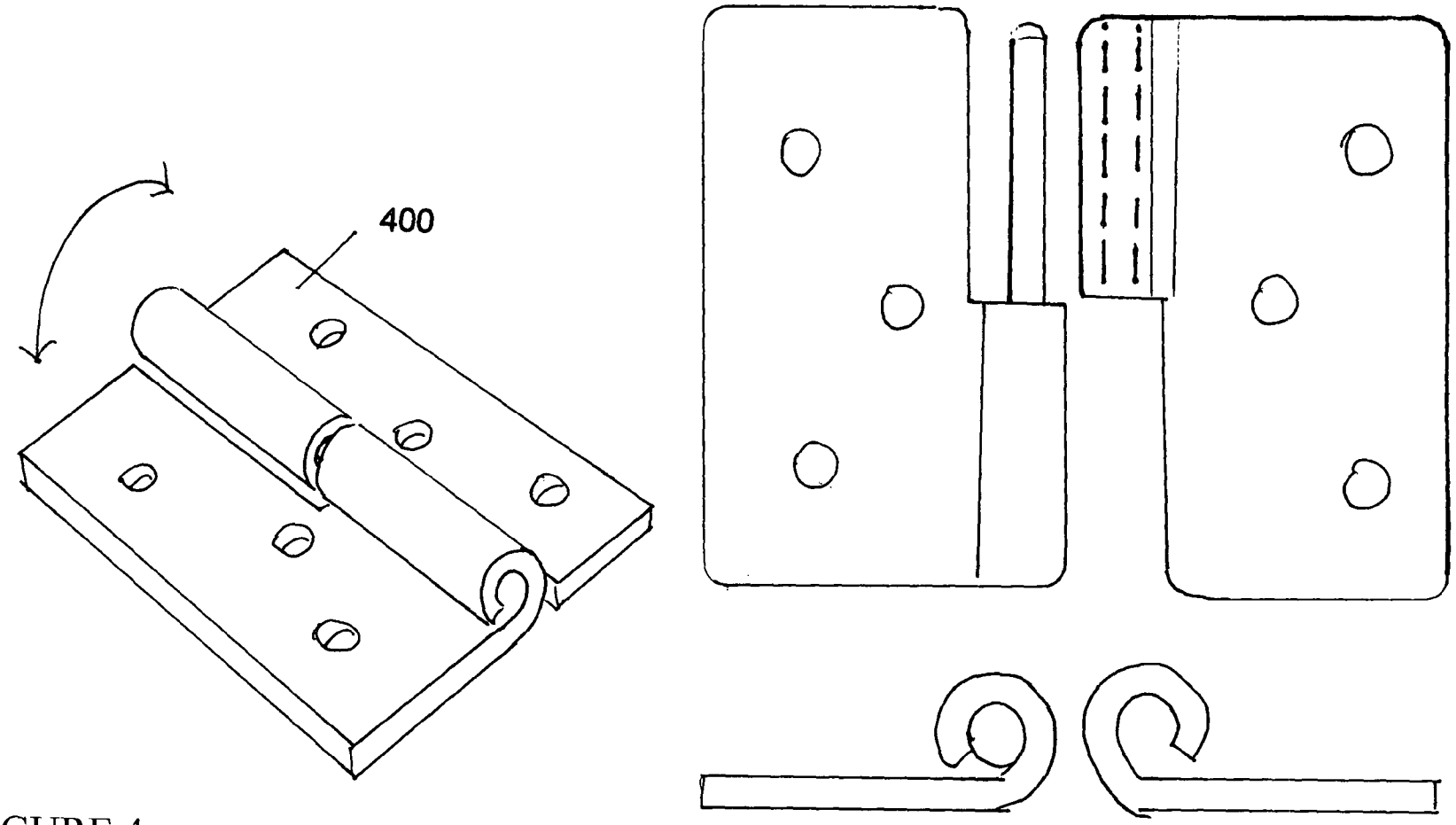
FIG. 4 is a somewhat simplified illustration of the slip hinge system.

FIG. 3 shows a simplified illustration of a skid pad assembly used to reduce shock and vibration. Because the container is designed to ship expensive electronics we have incorporated isolation rings specifically designed for shipping pallets of electronics. Isolation rings 301 are integrated into the container base FIG. 1*d* profile as part of the skid pad assembly. The isolation rings 301 are placed between the skid plate 302 and the container base 100. The rings 301 are designed to absorb shock and vibration. A metal sleeve 303 allows the assembly to move for compression. The assembly is attached to the container with a bolt 304. Washers 305 & 307 are used help space the components. This allows location of the pad assembly and compression of the Isolation ring 301.

Container Features

Rotational molding is a unique method allowing the creation of both interior and exterior features on a hollow part. We will fill this hollow part with polyurethane foam which will provide the structure needed to support the cargo 101. The polyurethane foam can be formulated in various densities and will also absorb energy. Other common plastic manufacturing processes including blow can be used to generate hollow parts.

Cargo Isolation

We have designed a second layer of defense against impact and vibration that will allow for customization. The use of cushioning pads 102 material at strategic locations to cost effectively contains impact and vibration will promote safe shipment of electronic equipment. Cushioning pads 102 have been placed at supporting point 103 inside of the container.

Hardware

Our design incorporates lockable over center latches 104 and separating hinges 105 allowing lid removal without the use of tools. In addition, we have incorporated eight swing style handles 106 with 90 degree stops and return springs. Handles 106 are aligned on opposite sides of the container. Hardware will be fastened to the container by nut and bolt 107, screw anchor or retaining plates located on the inside surface.

Security Seals

We have provided hasps 108 for common security seals at both ends of the container. In addition each of our latches contains a hasp area for security tags and lock. Our design allows modification of tooling near latch area 109 for lock access.

Handling Compatibility.

Our container has been designed for use by pallet jack, forklift with tines, loaders, lift truck and trailer use. We have two way accesses 110 from either side while on flat surfaces or stacked 201. To help provide support and structure the container design includes skid plate mounting pads 111.

Portability

We have designed the container with eight spring loaded handles 106 allowing it to be carried by 2, 4, 6 or 8 people as need and available.

Handle Selection and Placement

Eight handles 106 have been provided allowing the container to be picked up by 2, 4, 6 or 8 persons. The handles have been placed high the base 100 to reduce the distance from the bottom of the container to the ground in case it is dropped. In addition, the handles are placed above the center of gravity for the container making it easier to control and carry. Handles feature return springs, 90 degree stop and artic glove access. The handles have been positioned inside recessed pockets 112 that will prevent them from being damaged during shipping but allow full access. This recess also provides protection from the weather elements. Handle are aligned and on opposite sides of the container.

Interior Storage

The container is designed to provide storage for long items. Support surface 102 have been provided on either end of the container. This allows support for the storage of these items and allows access and storage of items below. Large storage areas have also is provided for accessory items.

Breather Valve

A breather valve port 115 has been located on the front surface of the container 100 for easy access and service.

Tie Downs

Multiple Tie downs 116 have been located on the front and rear surfaces of the container for easy access, service and securing the container during shipping.

Expansion Room

Due to the containers length and size, the lid pocket 204 for the Base hem 117 has been increased on the ends of the container allowing additional room for material expansion.

Hinge Selection and Placement

Four hinges 400 have been placed opposite of the latches 113. The hinges are designed to be secured on either the vertical or horizontal surface of the container 100 and Lid 200. Hinges selected will allow for easy removal by sliding in one direction and separating lid assembly 200 from base assembly 100. The lid 200 is also designed to be removed for improved access to equipment 101 located in the base container 100. A male and female hinge 400 system allows the lid to be rotated open 180 degrees and then slid off stud pins 401.

Lid Features

The top surface of the lid 200 has been designed to promote stacking of this container during storage. Contours on the lid surface 202 have been designed to accept skid plate assemblies 400 and limit movement in three directions. Contours on the surface 202 have also been designed to shed water and prevent collection of water in pockets 201 and 203. To promote good part design, the top surface is slightly curved 200, 201, 202 and 203 to prevent oil canning during the manufacturing process and part removal process.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A shipping container comprising: a generally rectangular body of surrounding material containing a first component and a second component for opening and closing together providing access to a interior space defined by the surround material, each component containing an alignment, sealing profile and gasket extending along the mating edge of the first and second component; first and second components containing exterior mounted slip hinges between the first and second component spaced at increasing intervals to promote assembly along one mating edge allowing rotation and component separation; first and second components containing one or more latches positioned opposite hinges; first component lid containing recessed pockets promoting stacking and horizontal alignment between second component base when stacked, end mounted lift handles to gain access to cargo; second component base containing one or more recessed and covered tie downs; first and second component containing large radius exterior vertical corner, horizontal edge and surface features; first and second components containing conforming interior features for shipping components and reducing internal air volume; first and second component containing curved support surfaces with attached contouring dunnage at opposing ends; first and second component containing curved support surfaces with attached contouring dunnage that divides the container into segments; first and second component containing internal arch features transferring weight between the two components; first and second components containing storage configurations for one or more cargo assemblies; second component containing features allowing complete access to one or more cargo assemblies without removal of dunnage; vibration, shock and impact reducing skid plate assemblies; first and second component comprising end mounted security hasp preventing access; second component or base comprising pressure release valve or option; first and second components comprised of composite materials forming hollow compartments filled with polyurethane foam or energy dampening material.

2. The shipping container as claimed in claim 1 further including skid plate assemblies containing skid plates manufactured with composites, steel or wood; impact dampening, vibration and shock isolators materials including synthetic viscoelastic urethane polymer, rubber, commonly used materials, one or more springs and containers of air to cushion impact energy.

3. The shipping container as claimed in claim 1 further including integrated interior cargo cushioning pads manufactured with synthetic viscoelastic urethane polymer, rubber, commonly used materials for impact, damping, vibration and shock reduction.

* * * * *